US006412478B1

(12) United States Patent
Ruehlow et al.

(10) Patent No.: US 6,412,478 B1
(45) Date of Patent: Jul. 2, 2002

(54) BREATHER FOR INTERNAL COMBUSTION ENGINE

(75) Inventors: Gerald C. Ruehlow, Oconomowoc; Edward M. Haworth, Walworth; Dawei Chen, Brookfield, all of WI (US)

(73) Assignee: Generac Power Systems, Inc., Waukesha, WI (US)

( * ) Notice: Subject to any disclaimer, the term of this patent is extended or adjusted under 35 U.S.C. 154(b) by 0 days.

(21) Appl. No.: 09/753,367

(22) Filed: Jan. 2, 2001

(51) Int. Cl.[7] ..... F02B 25/06
(52) U.S. Cl. ..... 123/572; 123/572; 123/41.86
(58) Field of Search ..... 123/572, 573, 123/574, 41.86

(56) References Cited

U.S. PATENT DOCUMENTS 4,156,406 A 5/1979 Brandau et al.
4,597,372 A 7/1986 Furukawa
4,721,090 A * 1/1988 Kato ..... 123/572
5,058,542 A * 10/1991 Grayson et al. ..... 123/41.86
5,617,834 A 4/1997 Lohr
5,647,337 A 7/1997 Johnson et al.
5,957,118 A * 9/1999 Tateno et al. ..... 123/573
6,021,766 A 2/2000 Maeda et al.
6,029,638 A * 2/2000 Funai et al. ..... 123/572

* cited by examiner

*Primary Examiner*—Marguerite McMahon
(74) *Attorney, Agent, or Firm*—Boyle Fredrickson Newholm Stein & Gratz S.C.

(57) ABSTRACT

A breather is provided for mounting on a cylinder head of a crankcase of an engine in order to separate oil from the crankcase blow-by. The breather includes a rocker cover mounted to the cylinder head of the crankcase. A plate is positioned within a cavity in the rocker cover for separating the cavity into first and second portions. The plate has an opening therein for allowing the crankcase blow-by to flow from the first portion into the second portion of the cavity. An oil separator is disposed in the second portion of the cavity and includes baffles projecting from each side thereof. It is contemplated that the oil in the crankcase blow-by cling to the oil separator and the first and second sets of baffles as the crankcase blow-by flows therepast.

13 Claims, 2 Drawing Sheets

BREATHER FOR INTERNAL COMBUSTION ENGINE

FIELD OF THE INVENTION

This invention relates generally to an internal combustion engine, and in particular, to a breather which is mountable on a cylinder head of a crankcase of the internal combustion engine in order to separate oil from the crankcase blow-by.

BACKGROUND AND SUMMARY OF THE INVENTION

As is known, in internal combustion engines, pistons are housed within corresponding cylinders for reciprocal movement therein. Fuel and air enter a combustion chamber in a corresponding cylinder on a first side of a piston. The fuel in each combustion chamber is ignited so as to cause linear motion of the pistons within their corresponding cylinders. The linear motion of the pistons is converted into rotary motion by the crankshaft.

Ideally, all of the gases in the combustion chambers after ignition of the fuel are exhausted from the combustion chambers via an exhaust pipe for the engine. However, a portion of the combustion gases may pass between the piston rings and the cylinder walls of the cylinders housing the pistons. These combustion gases contain various by-products of combustion which may be harmful if vented to the environment. As such, in order to prevent discharge of the combustion gases directly into the environment, the combustion gases are routed through the crankcase and into the air intake system of the internal combustion engine.

During routing of the combustion gases to the air intake system of the engine, the combustion gases often become contaminated with oil mist as the high pressure combustion gases are blown past the piston rings into the crankcase. This mixture of combustion gases and oil mist is known as crankcase blow-by. It has been observed that if crankcase blow-by is inputted directly into the engine air intake system, excess carbon builds-up in the engine, thereby causing increased exhaust emissions. As is known, excessive exhaust emissions maybe harmful to the environment. Further, any oil mist in the crankcase blow-by which is fed back into the combustion chambers will be burned during operation of the internal combustion engine. As such, the consumption of oil by the internal combustion engine will increase, thereby increasing the overall costs associated with operating the same.

Therefore, it is a primary object and feature of the present invention to provide a breather for an internal combustion engine which separates oil from the crankcase blow-by.

It is a further object and feature of the present invention to provide a breather for an internal combustion engine which does not utilize any filtration material.

It is a still further object and feature of the present invention to provide a breather for an internal combustion engine which reduces the oil consumption and the hydrocarbon emissions of the same.

It is a still further object and feature of the present invention to provide a breather for an internal combustion engine which is simple and inexpensive to manufacture.

In accordance with the present invention, a breather is provided which is mountable on a cylinder head of a crankcase of an engine. The breather separates oil from the crankcase blow-by and includes a rocker cover mountable to the cylinder head of the crankcase. The rocker cover defines a cavity therein. A plate is positioned within the cavity of the rocker cover for separating the cavity into first and second portions. The plate has a first opening for allowing the crankcase blow-by to flow between the first and second portions of the cavity and a drain hole for allowing oil to drain from the second to the first cavity. An oil separator is positioned within the second portion of the cavity and has first and second sides. The oil separator divides the second portion of the cavity into a first upper chamber and a second lower chamber. A first set of baffles project from the first side of the oil separator into the upper chamber and a second set of baffles projects from the second side of the oil separator into the lower chamber. It is contemplated that the oil and the crankcase blow-by cling to the oil separator and the first and second sets of baffles as the crankcase blow-by flows therepast.

The oil separator includes an outer periphery spaced from the rocker cover so as to allow the crankcase blow-by to flow between the lower and upper chambers. The rocker cover includes a vent communicating with the second portion of the cavity for allowing the crankcase blow-by to exit the rocker cover. The oil separator and the first and second set of baffles are integrally molded and the second set of baffles engages the plate.

A check valve is positioned over the first opening in the plate. The check valve is movable between a first closed position wherein the crankcase blow-by is prevented from flowing from the first portion of the cavity into the second portion of the cavity and a second open position wherein the crankcase blow-by is allowed to flow from the first portion of the cavity into the second portion of the cavity. A plurality of ribs extend from the second side of the oil separator towards the plate. The check valve includes a flap interconnected to the plate. The flap engages the plurality of the ribs with the check valve in the opened position.

In accordance with a further aspect of the present invention, a breather is provided which is mountable on a cylinder head of a crankcase of an engine. The breather separates oil from the crankcase blow-by generated by the engine and includes a rocker cover mountable to the cylinder head of the crankcase. The rocker cover defines a cavity therein for receiving the crankcase blow-by. The plate is positioned within the cavity of the rocker cover for separating the cavity into first and second portions. The plate has a first opening for allowing the crankcase blow-by to flow between the first and second portions of the cavity. An oil separator is positioned within the second portion of the cavity for dividing the second portion of the cavity into a first upper chamber and a second lower chamber. The oil separator has first and second sides and an outer periphery spaced from the rocker cover so as to allow the crankcase blow-by to flow between the lower and the upper chambers. A first set of baffles project from the first side of the oil separator into the upper chamber and a second set of baffles project from the second side of the oil separator into the lower chamber.

The rocker cover includes a vent communicating with the second portion of the cavity for allowing the crankcase blow-by to exit the rocker cover. The oil separator and the first and second sets of baffles are integrally molded and the second set of baffles engages the plate.

A check valve is positioned over the first opening in the plate. The check valve is movable between a first closed position wherein the crankcase blow-by is prevented from flowing from the first portion of the cavity into the second portion of the cavity and a second open position wherein the crankcase blow-by is allowed to flow from the first portion of the cavity into the second portion of the cavity. A plurality of ribs extend from the second side of the oil separator towards the plate. The check valve includes a flap interconnected to the plate. When the check valve is in the opened position, the flap engages the ribs.

In accordance with a still further aspect of the present invention, a breather is provided for mounting on a cylinder head of a crankcase of an engine. The breather separates oil from the crankcase blow-by and includes a rocker cover mountable to the cylinder head of the crankcase. The rocker cover defines a cavity therein for receiving the crankcase blow-by therein. A plate is positioned within the cavity of the rocker cover for separating the cavity into first and second portions. The plate has an opening for allowing the crankcase blow-by to flow between the first and second portions of the cavity. A flap is interconnected to the plate and overlaps the opening. The flap is movable between a first closed position wherein the crankcase blow-by is prevented from flowing from the first portion of the cavity to the second portion of the cavity and a second open position wherein the crankcase blow-by is allowed to flow from the first portion of the cavity into the second portion of the cavity. An oil separator is positioned within the second portion of the cavity for dividing the second portion of the cavity into a first upper chamber and a second lower chamber. The oil separator has first and second sides and an outer periphery spaced from the rocker cover so as to allow the crankcase blow-by to flow between the upper and lower chambers. A plurality of ribs extend from the second side of the oil separator towards the plate. The flap engages the ribs when the flap is in the opened position. A first set of baffles projects from the first side of the oil separator into the upper chamber and a second set of baffles projects from the second side of the oil separator into the lower chamber.

The rocker cover includes a vent communicating with the second portion of the cavity for allowing the crankcase blow-by to exit the rocker cover. The oil separator and the first and second sets of baffles are integrally molded, and the second set of baffles engages the plate. It is contemplated that the plate includes a drain hole.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
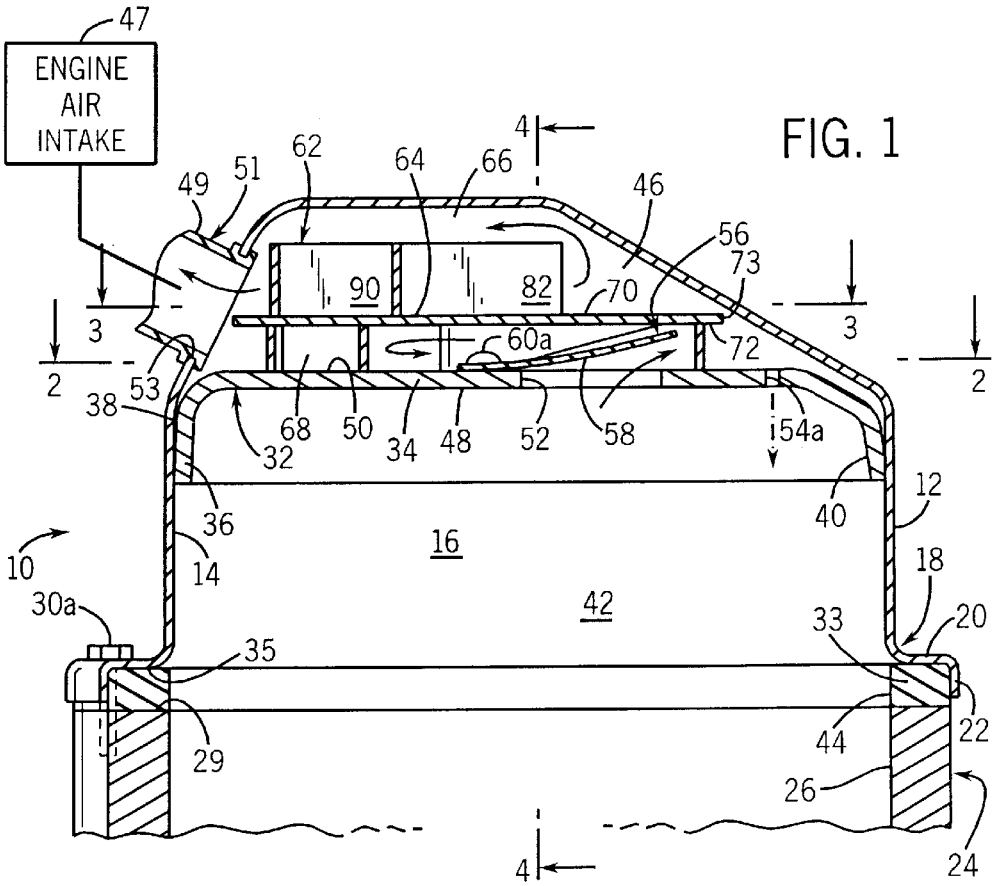
FIG. 1 is a cross-sectional view of a breather in accordance with the present invention mounted on the cylinder head of the crankcase of an engine.
Figure 4:
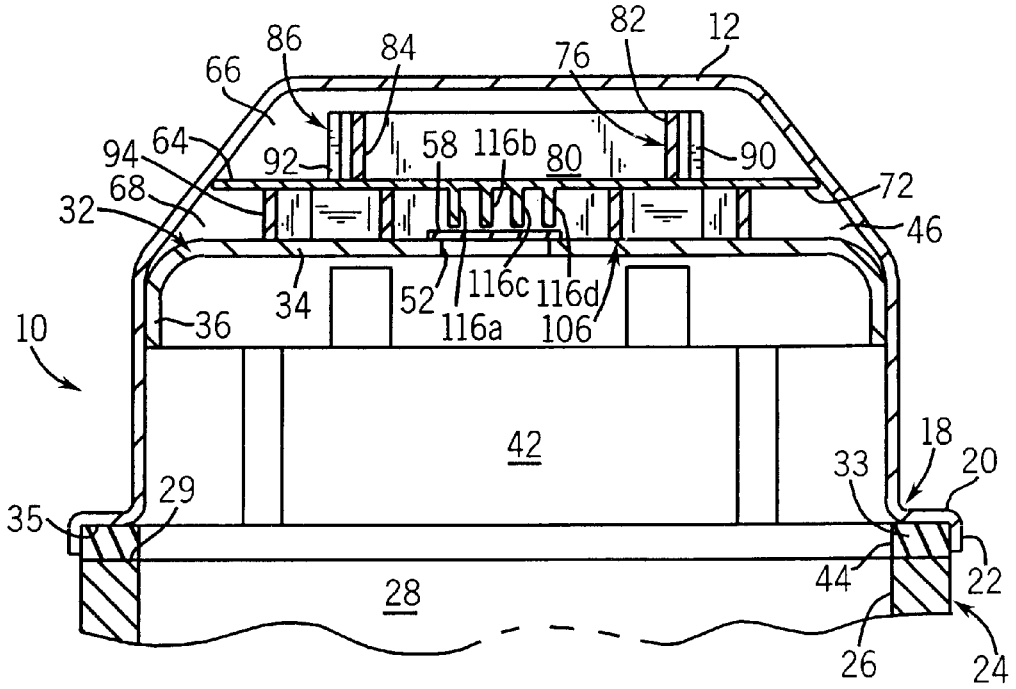
FIG. 4 is a cross-sectional view taken along line 4—4 of FIG. 1.

Referring to FIGS. 1 and 4, a breather in accordance with the present invention is generally designated by the reference numeral 10. Breather 10 includes a rocker cover 12 having an inner surface 14 which defines a cavity 16 therein. Rocker cover 12 includes an open end 18 having a mounting flange 20 projecting radially outward therefrom. Vertical wall 22 depends from the outer peripheral edge of flange 20 to facilitate the mounting of breather 10 to cylinder head 24 of the crankcase of an engine (not shown), as hereinafter described.

Cylinder head 24 of the crankcase includes an inner surface 26 which defines a crankcase vent port 28 which allows for the crankcase blow-by to exit cylinder head 24 of the crankcase. In order to mount rocker cover 12 on cylinder head 24 of the crankcase, rocker cover 12 is positioned such that flange 20 projecting from the open end 18 of rocker cover 12 overlaps the upper edge 29 of cylinder head 24 of the crankcase. Bolts 30*a–d* extend through mounting flange 20 and into upper edge 29 of cylinder head 24 of the crankcase so as to interconnect rocker cover 12 to cylinder head 24 of the crankcase. It is contemplated to provide a gasket 33 between lower surface 35 of mounting flange 20 and upper edge 29 of cylinder head 24 of the crankcase within vertical wall 22 so as to prevent the crankcase blow-by from passing between mounting flange 20 and upper edge 29 of cylinder head 24 of the crankcase into the environment external of the engine.

Plate 32 is positioned in cavity 16 of rocker cover 12 and includes a generally flat central portion 34 having an outer peripheral portion 36 depending therefrom. In the preferred embodiment, it is contemplated to form plate 32 from a plastic material, but other materials are possible without deviating from the scope of the present invention. Outer peripheral portion 36 of plate 32 includes inner surface 40 and an outer surface 38 which engages inner surface 14 of rocker cover 12 and is interconnected thereto in any suitable manner such as by silicone sealant or the like.

Plate 32 divides cavity 16 in rocker cover 12 into a first portion 42 which communicates with crankcase vent port 28 through central opening 44 in gasket 33 and a second portion 46 which communicates with engine air intake 47 through breather hose 49, and end 51 of which is received in opening 53 in rocker cover 12. Lower surface 48 of central portion 34 of plate 32 is directed towards first portion 42 of cavity 16 in rocker cover 12 and upper surface 50 of central portion 34 of plate 32 is directed towards second portion 46 of cavity 16 in rocker cover 12. Central portion 34 of plate 32 includes an opening 52 so as to allow the crankcase blow-by to flow from first portion 42 of cavity 16 in rocker cover 12 into second portion 46 of cavity 16 in rocker cover 12 therethrough. In addition, central portion 34 includes first and second drain holes 54*a* and 54*b*, respectively, which allow oil to pass from second portion 46 of cavity 16 in rocker cover 12 into cylinder head 24 of the crankcase through first portion 42 of cavity 16 in rocker cover 12 and through opening 44 in gasket 33.

Check valve 56 is mounted to the upper surface 50 of central portion 34 of plate 32. Check valve 56 includes a flap 58 interconnected to upper surface 50 of central portion 34 of plate 32 by first and second connectors 60*a* and 60*b*, respectively, so as to allow flap 58 to pivot between a first closed position, FIG. 4, wherein flap 58 overlaps opening 52 in central portion 34 of plate 32, and a second open position, FIG. 1, wherein second portion 46 of cavity 16 in rocker cover 12 may communicate with first portion 42 of cavity 16 and rocker cover 12 through opening 52 in central portion 34 of plate 32.

Oil separator 62 is positioned within second portion 46 of cavity 16 in rocker cover 12. Oil separator 62 includes a generally flat separation element 64 which divides second portion 46 of cavity 16 in rocker cover 12 into an upper chamber 66 and a lower chamber 68.

Figure 3:
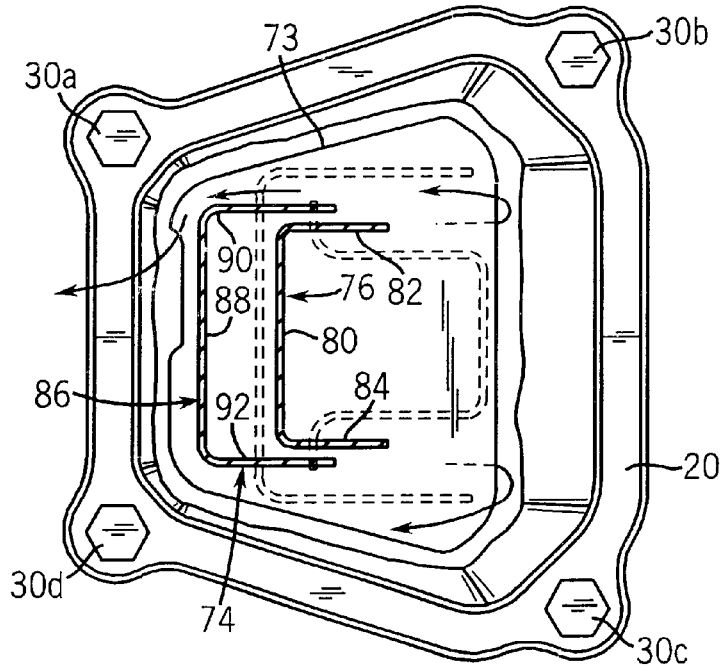
FIG. 3 is a cross-sectional view taken along line 3—3 of FIG. 1.

Separation element 64 includes a first upper side 70 directed towards upper chamber 66; second lower surface 72 directed towards lower chamber 68; and an outer peripheral edge 73. As best seen in FIGS. 3–4, a first set of baffles 74 project from upper surface 70 of separation element 64 into upper chamber 66. First set of baffles 74 includes an inner, generally U-shaped baffle 76 defined by base 80 and having first and second legs 82 and 84, respectively, projecting from opposite ends thereof. First set of baffles 74 further includes an outer, U-shaped baffle 86 defined by base 88 and first and second legs 90 and 92, respectively, projecting from opposite ends thereof. It is contemplated that a portion of inner baffle 76 be positioned between first and second legs 90 and 92, respectively, of outer baffle 86.

Figure 2:
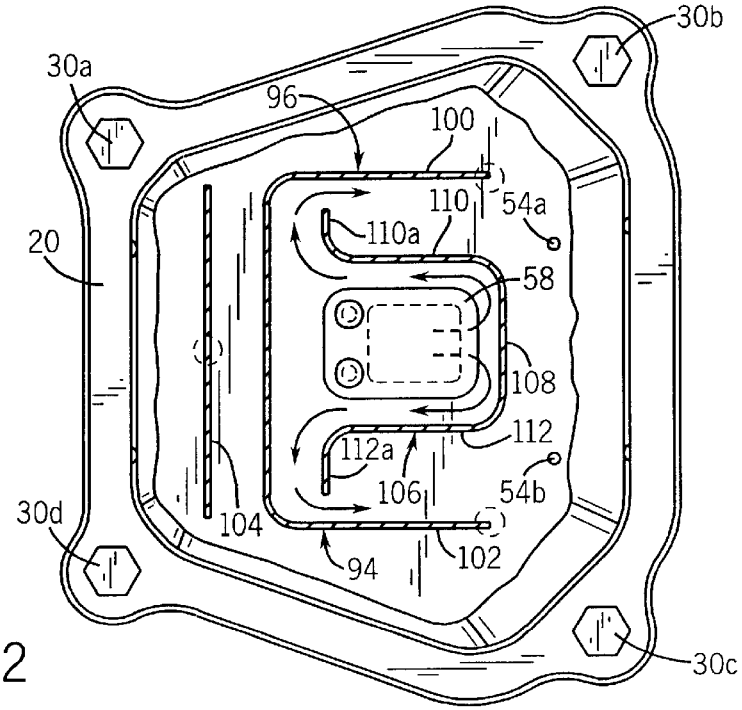
FIG. 2 is a cross-sectional view taken along line 2—2 of FIG. 1.

Referring to FIG. 2, a second set of baffles generally designed by the reference numeral 94, project from the lower side 72 of oil separator 64 and engages upper surface 50 of central portion 34 of plate 32. Second set of baffles 94 includes a first, generally U-shaped baffle 96 having a base 98 and first and second legs 100 and 102 projecting from opposite ends thereof. Second set of baffles 94 further includes generally planar baffle 104 which is generally parallel to base 98 of first U-shaped baffle 96 of the second set of baffles 94. A second U-shaped baffle 106 is positioned between first and second legs 100 and 102, respectively, of first U-shaped baffle 96 of the second set of baffles 94. Second U-shaped baffle 106 is defined by base 108 and first and second legs 110 and 112, respectively, projecting from opposite ends thereof Terminal ends 110*a* and 112*a* of legs 110 and 112, respectively, of second U-shaped baffle 106 diverge from each other towards corresponding legs 100 and 102, respectively, of first U-shaped baffle 96.

It is contemplated that flap 58 mounted to the upper surface 50 of central portion 34 of plate 32 be centrally disposed between first and second legs 110 and 112, respectively, of second U-shaped baffle 108. A plurality of generally triangular ribs 116*a–d* project from the lower surface 72 of separation element 64 so as to overlap flap 58 of check valve 56. As described, ribs 116*a–d* act to limit the opening of flap 58 of check valve 56 in response to the pressure of the crankcase blow-by passing through opening 52 in central portion 34 of plate 32.

In the preferred embodiment, separation element 64, first and second sets of baffles 74 and 94, respectively, and ribs 116*a–d*, are integrally molded such that oil separator 62 is a single unit. It is contemplated to form oil separator 62 from a plastic material, but other materials are possible without deviating from the scope of the present invention.

In operation, the crankcase blow-by exits the cylinder head 24 of the crankcase through crankcase vent port 28 into first portion 42 of cavity 16 in rocker cover 12. The pressure of the crankcase blow-by urges flap 58 of check valve 56 from the closed position, FIG. 4, to the open position, FIG. 1. With flap 58 of check valve 56 in the open position, FIG. 1, the crankcase blow-by is free to pass through opening 52 in plate 32 into lower chamber 66.

As the crankcase blow-by flows through the lower chamber 66 past the second set of baffles 94, the oil mist within the crankcase blow-by condenses onto baffles 96, 104, and 106 of the second set of baffles 94. As best seen in FIG. 2, given the arrangement of baffles 96 and 106, the direction of the flow path of the crankcase blow-by is reversed at least twice in order to facilitate the condensation of the oil mist on baffles 96, 104 and 106 of the second set of baffles 94.

As best seen in FIGS. 1 and 3, after flowing pass baffles 96, 104 and 106 of the second set of baffles 94, the crankcase blow-by flows about the outer peripheral edge 73 of separation element 64 and into upper chamber 66. Within upper chamber 66, the crankcase blow-by flows past baffles 76 and 86 of the first set of baffles 74 so as to allow additional oil mist to condense on baffles 76 and 86 of the first set of baffles 74. After passing over the first and second set of baffles 74 and 94, respectively, the "cleaned" crankcase blow-by is provided to engine air intake 47 through breather hose 49. It can be appreciated that the condensed oil may drain back into cylinder head 24 of the crankcase through drain holes 54*a* and 54*b* in plate 32.

Various modes of carrying out the invention are contemplated as being within the scope of the following claims particularly pointing out and distinctly claiming the subject matter which is regarded as the invention.

We claim:

1. A breather mountable on a cylinder head of a crankcase of an engine for separating oil from the crankcase blow-by, comprising:

a rocker cover mountable to the cylinder head of the crankcase, the rocker cover defining a cavity therein;

a plate positioned within the cavity of the rocker cover for separating the cavity into first and second portions, the plate having a first opening for allowing the crankcase blow-by to flow between the first and second portions of the cavity and a drain hole for allowing oil to drain from the second cavity to the first cavity;

an oil separator positioned within the second portion of the cavity and having first and second sides, the oil separator dividing the second portion of the cavity into a first upper chamber and a second lower chamber;

a first set of baffles projecting from the first side of the oil separator into the upper chamber; and a second set of baffles projecting from the second side of the oil separator into the lower chamber;

wherein the second set of baffles engages the plate; and wherein oil in the crankcase blow-by clings to the oil separator and the first and second sets of baffles as the crankcase blow-by flows therepast.

2. A breather mountable on a cylinder head of a crankcase of an engine for separating oil from the crankcase blow-by, comprising:

a rocker cover mountable to the cylinder head of the crankcase, the rocker cover defining a cavity therein;

a plate positioned within the cavity of the rocker cover for separating the cavity into first and second portions, the plate having a first opening for allowing the crankcase blow-by to flow between the first and second portions of the cavity and a drain hole for allowing oil to drain from the second cavity to the first cavity;

an oil separator positioned within the second portion of the cavity and having first and second sides, the oil separator dividing the second portion of the cavity into a first upper chamber and a second lower chamber;

a first set of baffles projecting from the first side of the oil separator into the upper chamber;

a second set of baffles projecting from the second side of the oil separator into the lower chamber; and a check valve positioned over the first opening in the plate, the check valve being movable between a first closed position wherein the crankcase blow-by is prevented from flowing from the first portion of the cavity into the second portion of the cavity and a second open position wherein the crankcase blow-by is allowed to flow from the first portion of the cavity into the second portion of the cavity wherein oil in the crankcase blow-by clings to the oil separator and the first and second sets of baffles as the crankcase blow-by flows therepast.

3. A breather mountable on a cylinder head of a crankcase of an engine for separating oil from the crankcase blow-by, comprising:

a rocker cover mountable to the cylinder head of the crankcase, the rocker cover defining a cavity therein;

a plate positioned within the cavity of the rocker cover for separating the cavity into first and second portions, the plate having a first opening for allowing the crankcase blow-by to flow between the first and second portions of the cavity and a drain hole for allowing oil to drain from the second cavity to the first cavity;

an oil separator positioned within the second portion of the cavity and having first and second sides, the oil separator dividing the second portion of the cavity into a first upper chamber and a second lower chamber;

a first set of baffles projecting from the first side of the oil separator into the upper chamber;

a second set of baffles projecting from the second side of the oil separator into the lower chamber; and a plurality of ribs extending from the second side of the oil separator towards the plate;

wherein oil in the crankcase blow-by clings to the oil separator and the first and second sets of baffles as the crankcase blow-by flows therepast; and wherein the oil separator includes an outer periphery spaced from the rocker cover so as to allow the crankcase blow-by to flow between the lower and the upper chambers.

4. The breather of claim 3 wherein the check valve includes a flap interconnected to the plate, the flap engaging the ribs with the check valve in the open position.

5. A breather mountable on a cylinder head of a crankcase of an engine for separating oil from crankcase blow-by, comprising:

a rocker cover mountable to the cylinder head of the crankcase, the rocker cover defining a cavity therein for receiving the crankcase blow-by;

a plate positioned within the cavity of the rocker cover for separating the cavity into first and second portions, the plate having a first opening for allowing the crankcase blow-by to flow between the first and second portions of the cavity;

an oil separator positioned within the second portion of the cavity for dividing the second portion of the cavity into a first upper chamber and second lower chamber, the oil separator having first and second sides and an outer periphery spaced from the rocker cover so as to allow the crankcase blow-by to flow between the lower and the upper chambers;

a first set of baffles projecting from the first side of the oil separator into the upper chamber; and a second set of baffles projecting from the second side of the oil separator into the lower chamber;

wherein the second set of baffles engages the plate.

6. A breather mountable on a cylinder head of a crankcase of an engine for separating oil from crankcase blow-by, comprising:

a rocker cover mountable to the cylinder head of the crankcase, the rocker cover defining a cavity therein for receiving the crankcase blow-by;

a plate positioned within the cavity of the rocker cover for separating the cavity into first and second portions, the plate having a first opening for allowing the crankcase blow-by to flow between the first and second portions of the cavity;

an oil separator positioned within the second portion of the cavity for dividing the second portion of the cavity into a first upper chamber and second lower chamber, the oil separator having first and second sides and an outer periphery spaced from the rocker cover so as to allow the crankcase blow-by to flow between the lower and the upper chambers;

a first set of baffles projecting from the first side of the oil separator into the upper chamber; and a second set of baffles projecting from the second side of the oil separator into the lower chamber; and a check valve positioned over the first opening in the plate, the check valve being movable between a first closed position wherein a crankcase blow-by is prevented from flowing from the first portion of the cavity into the second portion of the cavity and a second open position wherein the crankcase blow-by is allowed to flow from the first portion of the cavity into the second portion of the cavity.

7. A breather mountable on a cylinder head of a crankcase of an engine for separating oil from crankcase blow-by, comprising:

a rocker cover mountable to the cylinder head of the crankcase, the rocker cover defining a cavity therein for receiving the crankcase blow-by;

a plate positioned within the cavity of the rocker cover for separating the cavity into first and second portions, the plate having a first opening for allowing the crankcase blow-by to flow between the first and second portions of the cavity;

an oil separator positioned within the second portion of the cavity for dividing the second portion of the cavity into a first upper chamber and second lower chamber, the oil separator having first and second sides and an outer periphery spaced from the rocker cover so as to allow the crankcase blow-by to flow between the lower and the upper chambers;

a first set of baffles projecting from the first side of the oil separator into the upper chamber;

a second set of baffles projecting from the second side of the oil separator into the lower chamber; and a plurality of ribs extending from the second side of the oil separator towards the plate;

wherein the rocker cover includes a vent communicating with the second portion of the cavity for allowing the crankcase blow-by to exit the rocker cover.

8. The breather of claim 7 wherein the check valve includes a flap interconnected to the plate, the flap engaging the ribs with the check valve in the open position.

9. A breather mountable on a cylinder head of a crankcase of an engine for separating oil from the crankcase blow-by, comprising:

a rocker cover mountable to the cylinder head of the crankcase, the rocker cover defining a cavity therein for receiving the crankcase blow-by therein;

a plate positioned within the cavity of the rocker cover for separating the cavity into first and second portions, the plate having an opening for allowing the crankcase blow-by to flow between the first and second portions of the cavity;

a flap interconnected to the plate and overlapping the opening, the flap movable between a first closed position wherein the crankcase blow-by is prevented from flowing from the first portion of the cavity into the second portion of the cavity and a second open position wherein the crankcase blow-by is allowed to flow from the first portion of the cavity into the second portion of the cavity;

an oil separator positioned within the second portion of the cavity for dividing the second portion of the cavity into a first upper chamber and a second lower chamber, the oil separator having first and second sides and an outer periphery spaced from the rocker cover so as to allow the crankcase blow-by to flow between the lower and the upper chambers;

a plurality of ribs extending from the second side of the oil separator towards the plate, the flap engaging the ribs with the flap in the open position;

a first set of baffles projecting from the first side of the oil separator into the upper chamber; and a second set of baffles projecting from the second side of the oil separator into the lower chamber.

10. The breather of claim 9 wherein the rocker cover includes a vent communicating with the second portion of the cavity for allowing the crankcase blow-by to exit the rocker cover.

11. The breather of claim 9 wherein the oil separator and the first and second sets of baffles are integrally molded.

12. The breather of claim 9 wherein the second set of baffles engages the plate.

13. The breather of claim 9 wherein the plate includes a drain hole.

* * * * *